United States Patent [19]

Garner

[11] Patent Number: 4,941,381

[45] Date of Patent: Jul. 17, 1990

[54] PORTABLE BUSINESS CARD SLIT CUTTER

[75] Inventor: Darryl M. Garner, Boca Raton, Fla.

[73] Assignee: Sandra Brown Garner, Tampa, Fla.

[21] Appl. No.: 204,894

[22] Filed: Jun. 10, 1988

[51] Int. Cl.[5] ..... B26F 1/18

[52] U.S. Cl. ..... 83/468.94; 83/520; 83/589; 83/599; 83/695

[58] Field of Search ..... 83/467 R, 589, 599, 83/600, 607, 608, 695, 520, 468.94; 281/2, 5

[56] References Cited

U.S. PATENT DOCUMENTS

| | | | |
|---|---|---|---|
| 914,613 | 3/1909 | Storlie | 83/599 |
| 2,295,903 | 9/1942 | Kennedy | 83/520 |
| 2,558,567 | 6/1951 | Kaeser | 83/589 |
| 2,959,082 | 11/1960 | Bialy | 83/598 |
| 3,408,889 | 11/1968 | Murphy | 83/599 |
| 4,542,286 | 9/1985 | Golarz | 281/5 |
| 4,879,932 | 11/1989 | Scalise et al. | 83/30 |

FOREIGN PATENT DOCUMENTS

| | | | |
|---|---|---|---|
| 582048 | 11/1976 | Switzerland | 83/607 |

*Primary Examiner*—Hien H. Phan

*Attorney, Agent, or Firm*—Harry W. Barron

[57] ABSTRACT

A portable business card slit cutter includes a base member and cutting member which is rotatably affixed to the base member. A pair of triangular shaped cutting blades are affixed to the cutting member and a corresponding pair of receiving slits are positioned on the base member so that the blades are inserted into the slits when the cutting member is rotated toward the base. When a sheet of paper is positioned on the base member, the blades cut slits in the paper. The blades are spaced apart by an amount so that, when the slits are cut, opposite corners of conventional business card may be inserted into and held by the slits. The slit cutter includes a paper stop for positioning the paper as well as a paper width positioner. The cutting member is affixed to the base by a hinge mechanism and held spaced apart therefrom by springs. The cutting blades are held by Tee shaped carriers which are inserted into Tee shaped carrier slots in the cutting member. The paper stop may be made movable and/or a plurality of carrier slots may be provided in order to permit vertical positioning of the business card on the sheet.

8 Claims, 2 Drawing Sheets

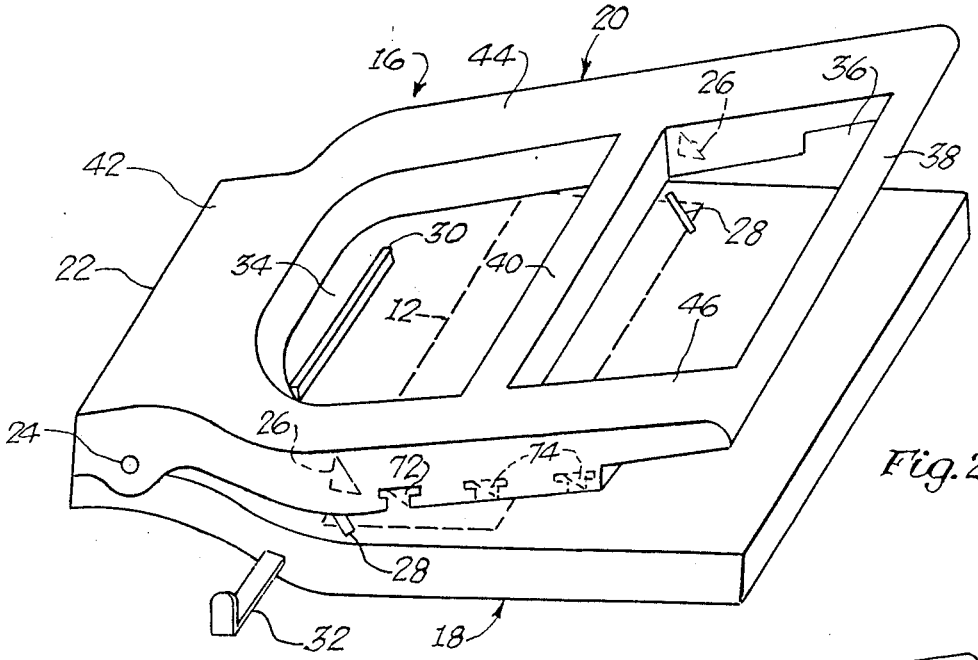
Fig. 2.
Fig. 3.
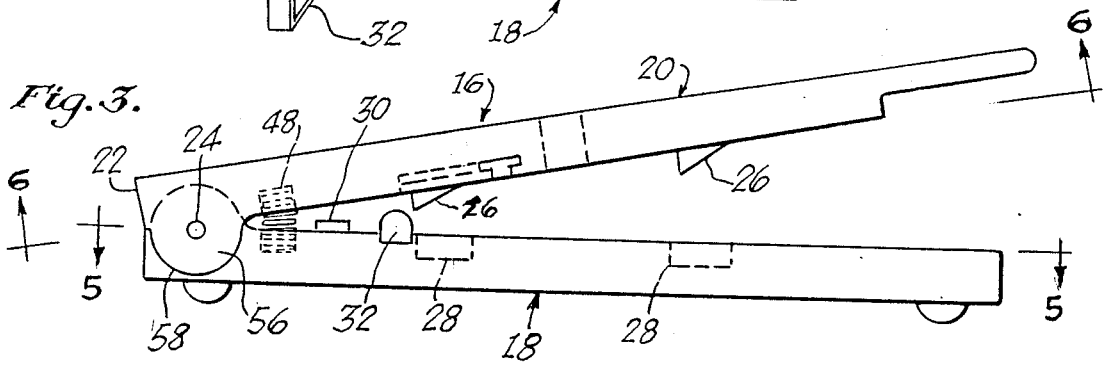
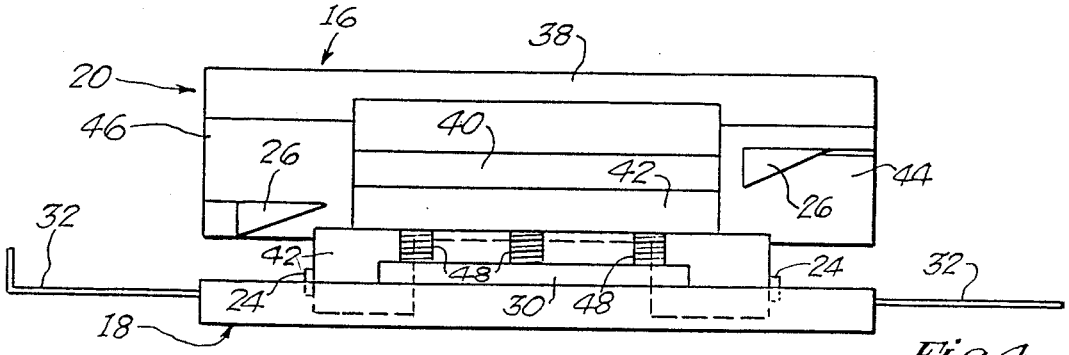
Fig. 4.
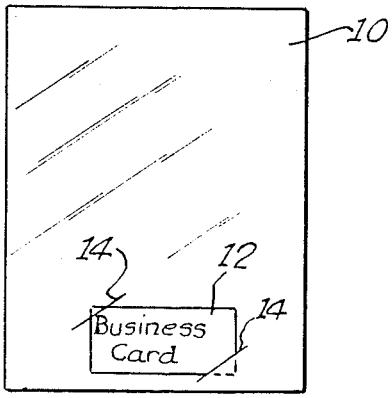
Fig. 1.
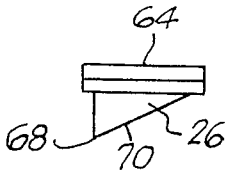
Fig. 7A.
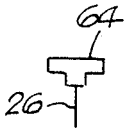
Fig. 7B.

PORTABLE BUSINESS CARD SLIT CUTTER

This invention relates to a portable slit punch, and more particularly, to such a punch useful for punching in a sheet a pair of slits adapted to having opposite corners of a business card inserted therein for the purpose of non-destructively affixing the business card to the sheet.

It is not uncommon for a person to send an advertisement, letter or other document to a recipient and attach a business card to that document. For example, people engaged in the advertising, real estate, insurance or other service professions often attach a business card to a letter or an advertisement which is mailed or delivered to a recipient. The business card typically is either stapled or attached with a paper clip to the document in order to accomplish the desired purpose. In either case, damage to the business card occurs and sheet, in that the staple leaves holes in the business card and the paper clip leaves depressions in the business card.

One other method of attaching a business card to a sheet that has been utilized in the past is to cut a pair of spaced parallel slits in the letter or advertisement and to then insert opposite corners of the business card into the slits. This technique is preferable because no damage is done to the card and the card may be easily removed and stored by the recipient of the document. The widespread use of this slit technique has been limited because the slits can only be cut with large and expensive cutters, not typically available to normal office personnel.

Heretofore, there has not been a portable office type slit punch which cuts the two required business card slits in a document to which a business card is to be attached. Cutting slits has only been done by commercial printers or binderies who possess the large and expensive slit cutters used to cut slits in an entire stack of documents at one time. However, in many instances, this is not practical, particularly where a need exists to attach a business card to a single document, such as a business letter, rather than to each sheet of a large quantity of custom prepared advertisements.

A portable business card slit cutter is needed for the common office in order to permit slits to be cut in various types of business documents. Such a portable slit cutter should be capable of cutting slits at different locations on a document, whereby the business card can be placed where desired or where space permits so that the card does not cover an important part of the message conveyed by the document.

In accordance with one aspect of this invention, there is provided a portable slit cutter for cutting slits in a sheet for the purpose of holding a business card. The slit cutter includes a base member having a pair of angled slit openings and a cutting member rotatably affixed to the base member. The cutting member has a pair of pointed blades positioned to be inserted into the slit openings as the cutting member is rotated toward the base. In addition, the slit openings and blades are position to cut the slits on the sheet, when inserted between said base member and said cutting member, at a separation to permit opposite diagonal corners of said business card to be inserted therein.

One preferred embodiment of the subject invention is hereafter described, with specific reference being made to the following Figures, in which;

FIG. 1 shows a sheet having a business card affixed thereto using slits cut by the portable slit cutter of the subject invention;

FIG. 2 is a perspective view of the portable slit cutter of the subject invention;

FIG. 3 is a side view of the portable slit cutter shown in FIG. 2;

FIG. 4 is a front view of the portable slit cutter shown in FIG. 2;

FIGS. 7A and 7B are the front and side views, respectively, of the blade and carrier used with the portable slit cutter shown in FIG. 2.

Figure 6:
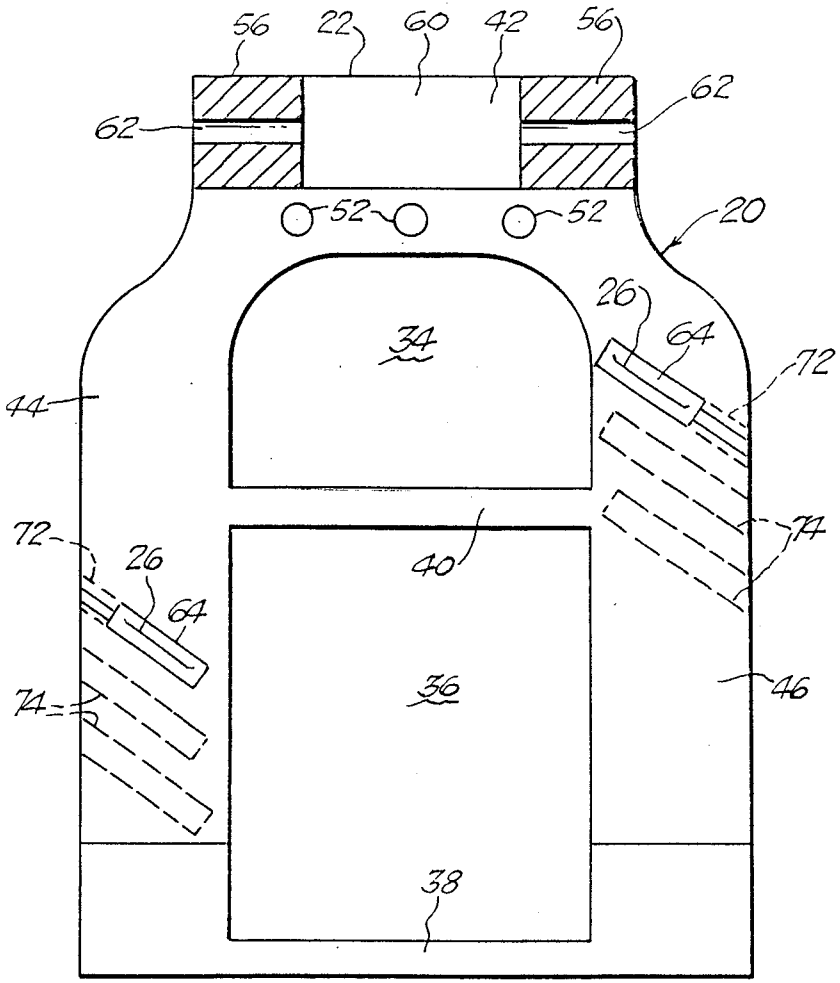
FIG. 6 is a view taken across lines 6—6 of FIG. 3.

Referring now to FIG. 1, a sheet 10 is shown having a business card 12 affixed thereto with opposite corners inserted into a pair of slits 14. Slits 14 are generally parallel to one another and spaced apart by approximately 3½ inches, so as to receive and hold opposite corners of a conventional business card. Such a conventional business card measures 2 inches by 3½ inches and has a diagonal distances of approximately 4 inches. While business card 12 is shown positioned in the center of the lower edge of sheet 10, it may be positioned at any point on sheet 10 as desired by the sender of sheet 10. Typically however, it will be positioned along either the lower edge or upper edge of sheet 10 rather than in the middle sheet 10 in order to avoid covering a part of the message conveyed by sheet 10.

Figure 5:
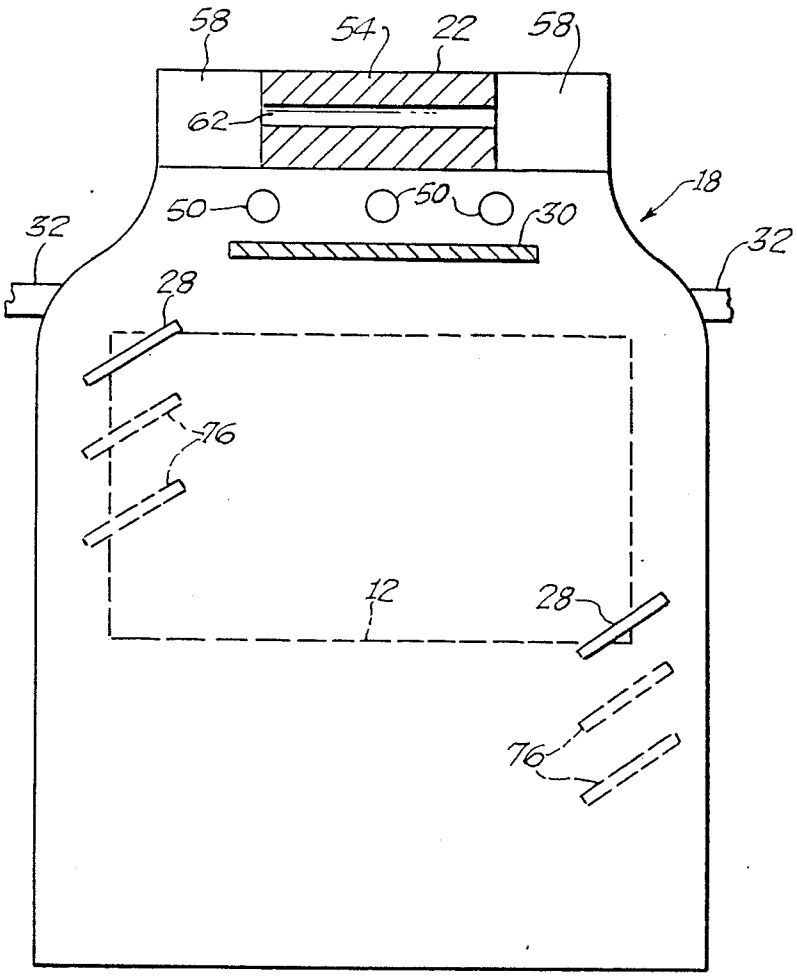
FIG. 5 is a view taken across line 5—5 of FIG. 3.

Referring now to FIGS. 2 through 6, the detail construction of the portable slit cutter 16 is shown. Slit cutter 16 has two principle components, which are a base 18 and a cutting member 20. Cutting member 20 is rotatably affixed to the back end 22 of base 18 by a pin 24. A pair of cutting blades 26 are attached to the underside of cutting member 20 and a pair of blade receiving slits 28 are formed in base 18. When cutting member 20 is rotated toward base 18, blades 26 are aligned with and fit within the corresponding receiving slits 28.

A paper stop 30 is affixed to the rear portion of base 18 against which sheet 10 may be positioned. Preferably paper stop 30 is positioned such that when slits 14 are cut in sheet 10, business card 12 will be approximately ½ inch from the bottom of sheet 10. Paper stop 30 may be made moveable between different positions in order to permit business card 12 to be positioned at other locations on sheet 10. In addition, a paper positioner 32 is provided and slides through base 10 so as to permit the lateral positioning of business card 12 on sheet 10 at any desired location along the width of sheet 10.

Base 18 is generally of a solid construction. However, cutting member 20 has a pair of relative large openings 34 and 36 therein to permit the user of slit cutter 16 to be able to view sheet 10 when inserted into slit cutter 16. In other words, cutting member 20 is primarily of a frame type construction and has a handle 38, a brace 40, a back member 42 and side members 44 and 46. Brace 40 may be positioned to be across the position where the business card 12 would be positioned on an inserted sheet 10 so as to permit easy alignments thereof. Paper stop 30 is positioned on base 14 so that when cutting member 20 is rotated toward base 18, paper stop 30 is within opening 34. In this manner, paper stop 30 does not interfere with the rotation of member 20 toward base 18.

Cutting member 20 is maintained in the open, or up, position, as shown in FIG. 2, by three springs 48 placed in and held by spring receiving holes 50 and 52 in respective base member 18 and cutting member 20. When cutting member is rotated towards base 18 by pressure applied to handle 38, springs 48 are compressed and when the pressure on handle 38 is released, springs 48 cause cutting member 20 to return to the open position shown in FIG. 2. In addition, a rotational stop means (not shown) may be included to prevent cutting member 20 from opening by an amount more than that shown in FIG. 2.

The manner in which cutting member 20 is rotatably affixed to base 18 is accomplished by a single semicircular extension 54 in the center of base 18 and a pair semicircular extension 56 from the ends along the back end 22 of cutting member 20. In addition, there is provided a pair of semicircular indents 58 in base 18 and a single semicircular indent 60 in cutting member 20. Extensions 54 and 56 and indents 58 and 60 are sized and positioned so that the extensions 54 and 56 fit into the indents 58 and 60. Pin 24 then slides a hole 62 in each of the extensions 58 and 60 to form the rotatable hinge connection.

Referring now to FIGS. 7A and 7B, the blade 26 and carrier 64 holding blade 26 will now be described. Blade 26 is preferably triangular shaped having a sharp pointed edge 68 and cutting surface 70, so as to permit a smooth cut to be made in sheet 10. Carrier 64 is generally Tee shaped with blade 26 extending downward from the vertical portion of the Tee. By providing blade 26 and carrier 64 in the manner described, the blades 26 may be replaced in portable slit cutter 16 when they become dull or damaged. Further, as will be described hereafter, it may be desirable to reposition the blades 26 to different locations so as to permit business card 12 to be positioned at different vertical positions along sheet 10.

Referring again to FIGS. 2, 5 and 6, carrier slots 72 are provided on each side member 44 of cutting member 20. Slots 72 are sized to permit carrier 64 to be slidably inserted or removed therefrom and are of a length inward from the outside edge of side members 44 so as to permit carrier 64 to correctly position blade 26 when fully inserted in slot 72. Carrier slots 72 are thus Tee shaped and sized to slidably receive the Tee shaped carrier 68 holding blade 26. When carrier 64 is positioned entirely within carrier slot 72, blade 26 will be properly positioned.

In order to obtain vertical positioning of card 12 on sheet 10, one or more alternate carrier slots 74 and alternate slits 76 may be provided. In this manner, the carrier 64 holding blade 26 may be placed in any corresponding pair of the alternate slots 74. By so doing, the slits 14 holding business 12 are moved away from the edge of sheet 10. While only two alternate slots 74 and slits 76 have been shown in FIGS. 2, 5 and 6, it should be understood that any number may be provided to provide vertical adjustment to card 12 on sheet 10. For example, each of the alternate slots 74 and slits 76 may be spaced apart by ½ inch to provide ½ inch indexed spacing along the length of sheet 10. As previously mentioned, stop 30 may also be made discretely movable to accomplish the same function or may be made movable using a screw mechanism to so as to fill in the gaps between the discreet positions permitted by alternate slots 74 and alternate slits 76.

What is claimed is:

1. A portable slit cutter for cutting slits in a sheet for the purpose of holding a business card, said slit cutter comprising:

a base member having a plurality of pairs of angled slit openings, each pair of openings being spaced from the remaining pairs of openings and each opening of each pair of openings being spaced from the other opening of that pair of openings;

a cutting member rotatably affixed to said base member, said cutting member having a plurality of pairs of blade receivers each aligned with one of said openings when said cutting member is rotated towards said base; and a pair of pointed blades inserted into one of said plurality of pairs of said blade receivers;

said slit openings and blades being positioned to cut said slits on said sheet, when said sheet is inserted between said base member and said cutting member, at a separation to permit opposite diagonal corners of said business card to be inserted therein, the particular one of said pairs of blade receivers having said blades positioned therein determining the position of said slits on said sheet.

2. The invention according to claim 1 wherein said base further includes sheet stop means against which said sheet is positioned in said cutter.

3. The invention according to claim 2:

wherein said blade receiver each include a slot; and wherein each of said blades is held by a carrier which is insertable into one of said blade receiver slots.

4. The invention according to claim 3 wherein said carriers are removable from said blade receiver slots.

5. The invention according to claim 3 wherein the particular one of said pairs of blade receivers having said blades positioned therein determines the position of said slits on said sheet relative to said sheet stop means when said paper is positioned against said sheet stop means.

6. The invention according to claim 2 wherein the particular one of said pairs of blade receivers having said blades positioned therein determines the position of said slits on said sheet relative to said sheet stop means when said paper is positioned against said sheet stop means.

7. The invention according to claim 1 wherein said cutter further includes biasing means between said base means and said cutting member to bias said base means and said cutting member away from one another.

8. The invention according to claim 1 wherein said cutting member including openings therein for viewing the position of said sheet.

* * * * *